US012467467B1

(12) United States Patent
Yi

(10) Patent No.: US 12,467,467 B1
(45) Date of Patent: Nov. 11, 2025

(54) HANDHELD APPARATUS

(71) Applicant: Dongguan Mengqiqi Digital Co., Ltd., Dongguan (CN)

(72) Inventor: Huang Yi, Zhuzhou (CN)

(73) Assignee: Dongguan Mengqiqi Digital Co., Ltd., Dongguan (CN)

( * ) Notice: Subject to any disclaimer, the term of this patent is extended or adjusted under 35 U.S.C. 154(b) by 0 days.

(21) Appl. No.: 19/231,787

(22) Filed: Jun. 9, 2025

(30) Foreign Application Priority Data

May 13, 2025 (CN) ..... 202520945419.8

(51) Int. Cl.
*F04D 25/08* (2006.01)
*F04D 29/40* (2006.01)

(52) U.S. Cl.
CPC ..... *F04D 25/084* (2013.01); *F04D 29/403* (2013.01)

(58) Field of Classification Search
CPC ..... F04D 25/084; A45B 27/00; A45B 27/02
See application file for complete search history.

(56) References Cited

U.S. PATENT DOCUMENTS

2008/0069694 A1* 3/2008 Hernandez ..... F04D 29/601 416/63

FOREIGN PATENT DOCUMENTS

| | | | | |
|---|---|---|---|---|
| CN | 104573429 A | | 4/2015 | |
| CN | 104598790 A | | 5/2015 | |
| CN | 108691788 A | * | 10/2018 | ..... F04D 25/0673 |
| CN | 110874117 A | | 3/2020 | |
| CN | 220001072 U | * | 11/2023 | |
| TW | M325088 U | * | 1/2008 | |

* cited by examiner

*Primary Examiner* — Courtney D Heinle
*Assistant Examiner* — Danielle M. Christensen
(74) *Attorney, Agent, or Firm* — Nitin Kaushik

(57) ABSTRACT

The present invention discloses a handheld apparatus, including: a fan body provided with a snap-fit groove at its bottom; and a handle, detachably installed on the fan body, where the handle is provided with a locking mechanism, the locking mechanism includes a key switch, a locking portion, and an elastic member, the key switch is fixedly connected with the locking portion, and the elastic member is located between the locking portion and the handle, where the key switch is for a user to press to drive the locking portion to move downward, so that the locking portion and the snap-fit groove are unlocked; and the elastic member is configured to drive the locking portion to move upward, so that the locking portion and the snap-fit groove are locked. Through the present invention, a problem that existing fans are inconvenient to carry and have a monotonous function is resolved.

10 Claims, 7 Drawing Sheets

HANDHELD APPARATUS

CROSS-REFERENCE TO RELATED APPLICATIONS

The application claims priority to Chinese patent application No. 202520945419.8, filed on May 13, 2025, the entire contents of which are incorporated herein by reference.

TECHNICAL FIELD

The present invention relates to the technical field of handheld devices, and in particular, to a handheld apparatus.

BACKGROUND

With popularization of outdoor activities and mobile office scenarios, portable fans have gradually become important equipment in users' daily travel by virtue of their lightness and instant airflow delivery. Conventional fans usually use integrated fixed structures, and handles and fan bodies are fixedly connected, and as a result, the conventional fans have large overall volumes and are inconvenient to carry and are less practicable. In addition, the conventional fans have a single function, typically providing only basic airflow, and therefore, cannot provide more customized services based on diverse needs of users in different scenarios.

SUMMARY

A main objective of the present invention is to provide a handheld apparatus, to resolve a problem that existing fans are inconvenient to carry and have a monotonous function.

To achieve the foregoing objective, the present invention proposes a handheld apparatus, including:

a fan body provided with a snap-fit groove at its bottom; and a handle, detachably installed on the fan body, where the handle is provided with a locking mechanism, the locking mechanism includes a key switch, a locking portion, and an elastic member, the key switch is fixedly connected with the locking portion, and the elastic member is located between the locking portion and the handle, where the locking portion and the snap-fit groove have a locked state and an unlocked state; the key switch is for a user to press to drive the locking portion to move downward, so that the locking portion and the snap-fit groove are unlocked; and the elastic member is configured to drive the locking portion to move upward, so that the locking portion and the snap-fit groove are locked.

Optionally, a first clamping groove and a second clamping groove are disposed on sides of the fan body, a first clamping block and a second clamping block are correspondingly disposed on sides of the handle, the first clamping block slidably fits the first clamping groove, and the second clamping block is embedded into the second clamping groove when the handle is clamped into the fan body.

Optionally, a chamfer is disposed at an entrance of the first clamping groove, and a guide slope is correspondingly disposed at an end portion of the first clamping block.

Optionally, an input terminal is disposed at a bottom of the fan body, the handle is provided with an output terminal, and the input terminal and the output terminal form an electrical connection in a locked state.

Optionally, the handle is provided with an installation cavity for movement of the locking mechanism, and the locking mechanism is installed in the installation cavity.

Optionally, a positioning post is disposed in the installation cavity, and the elastic member is sleeved onto the positioning post.

Optionally, a guide slope is disposed on a side of the locking portion in an installation direction of the fan body.

Optionally, the key switch is provided with anti-skid bulges.

Optionally, a fan speed adjustment switch and a control switch are disposed on a surface of the fan body.

Optionally, a charge/discharge module is also disposed on the handle.

Beneficial effects of the present invention are as follows: This application proposes the handheld apparatus, where the handheld apparatus includes the fan body and the handle detachably installed on the fan body. The fan body is provided with the snap-fit groove at its bottom, the handle is provided with the locking mechanism, the locking mechanism is composed of the key switch, the locking portion, and the elastic member, the key switch is fixedly connected with the locking portion, and the elastic member is located between the locking portion and the handle. Through this structural design, the locked state and the unlocked state of the locking portion and the snap-fit groove can be switched. When the user presses the key switch, the locking portion is driven to move downward, so that the locking portion and the snap-fit groove are unlocked, and at this time, the handle can be removed from the fan body, to effectively reduce an overall volume of the fan, thereby facilitating storage and carrying and improving portability of the product. When the key switch is released, the elastic member drives the locking portion to move upward by virtue of its own elasticity, so that the locking portion and the snap-fit groove are locked, to firmly install the handle onto the fan body, thereby ensuring normal use of the fan. In addition, the charge/discharge module is disposed on the handle and can provide a charging service for another electronic device in outdoor or mobile scenarios, which expands functional practicability of the product and enhances competitiveness of the product on the market.

BRIEF DESCRIPTION OF DRAWINGS

In order to explain embodiments of the present invention or the technical solutions in the prior art more clearly, the following briefly introduces the drawings required to describe the embodiments or the prior art. Obviously, the drawings in the following description are only some embodiments of the present invention. Persons skilled in the art may obtain other drawings based on structures shown in these drawings without creative efforts.

DESCRIPTION OF REFERENCE SIGNS

Figure 1:
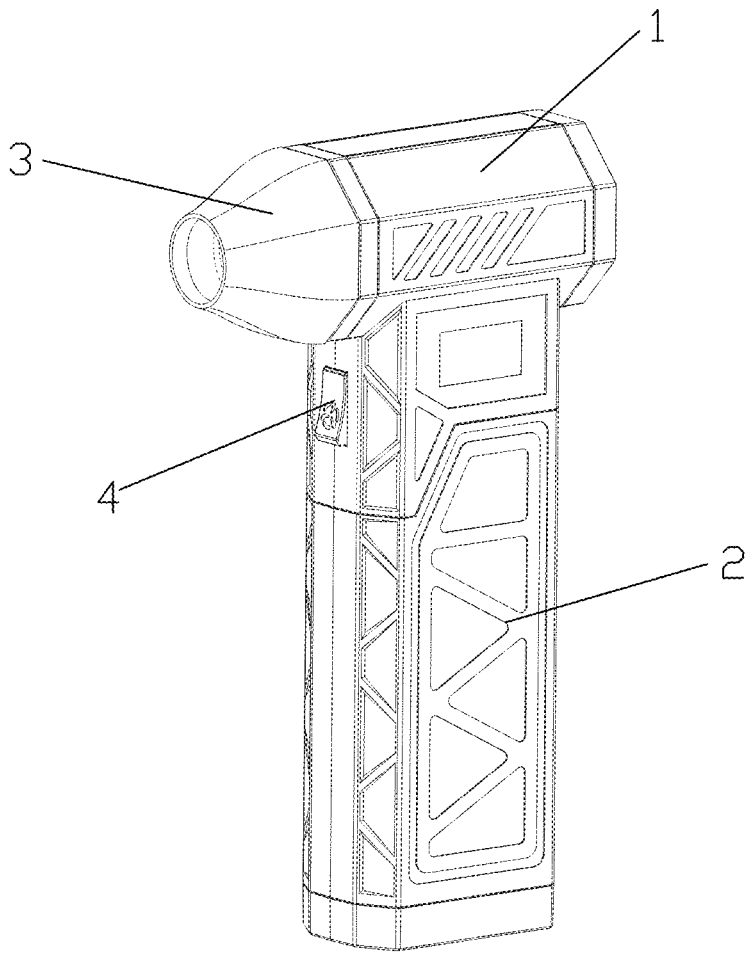
FIG. 1 is a schematic structural diagram of a handheld apparatus in the present invention.

1. fan body; 11. snap-fit groove; 12. first clamping groove; 121. chamfer; 13. second clamping groove; 14. input terminal;
2. handle; 21. installation cavity; 22. positioning post; 23. output terminal; 24. first clamping block; 241. guide slope; 25. second clamping block;
3. nozzle;
4. fan speed adjustment switch;
5. control switch;
6. locking mechanism; 61. key switch; 62. locking portion; 621. guide slope; 63. elastic member;
7. charge/discharge module; and
8. display screen.

The realization, functional characteristics and advantages of the objective of the present invention are further described with reference to the drawings in conjunction with the embodiments.

DETAILED DESCRIPTION OF THE EMBODIMENTS

The following clearly and completely describes the technical solutions in the embodiments of the present invention with reference to the drawings in the embodiments of the present invention. Apparently, the described embodiments are some but not all of the embodiments of the present invention. Based on the embodiments of the present invention, all other embodiments obtained by those skilled in the art without creative labor shall fall within the protection scope of the present invention.

It should be noted that if the embodiments of the invention involve directional indications (such as up, down, left, right, front, back, . . . ), the directional indications are only used to explain a relative position relationship and movement among various components under a specific posture (as shown in the drawings). If the specific posture changes, the directional indication also changes accordingly.

In addition, if there are descriptions of "first", "second" and the like in the embodiments of the invention, the descriptions of "first", "second" and the like are only intended for description, and shall not be understood as an indication or implication of relative importance or implicit indication of a quantity of indicated technical features. Therefore, the features defined with "first" and "second" may explicitly or implicitly include at least one of the features. In addition, the meaning of "and/or" in the whole text is to include three parallel schemes. Taking "A and/or B" as an example, "A and/or B" includes scheme A, scheme B, or a scheme that A and B are satisfied at the same time. In addition, the technical solutions in the embodiments may be combined with each other on the premise that they may be achieved by persons of ordinary skills in the art. When a combination of technical solutions is contradictory or cannot be achieved, it should be considered that such combination of technical solutions does not exist and also does not fall within the protection scope of the invention.

Figure 2:
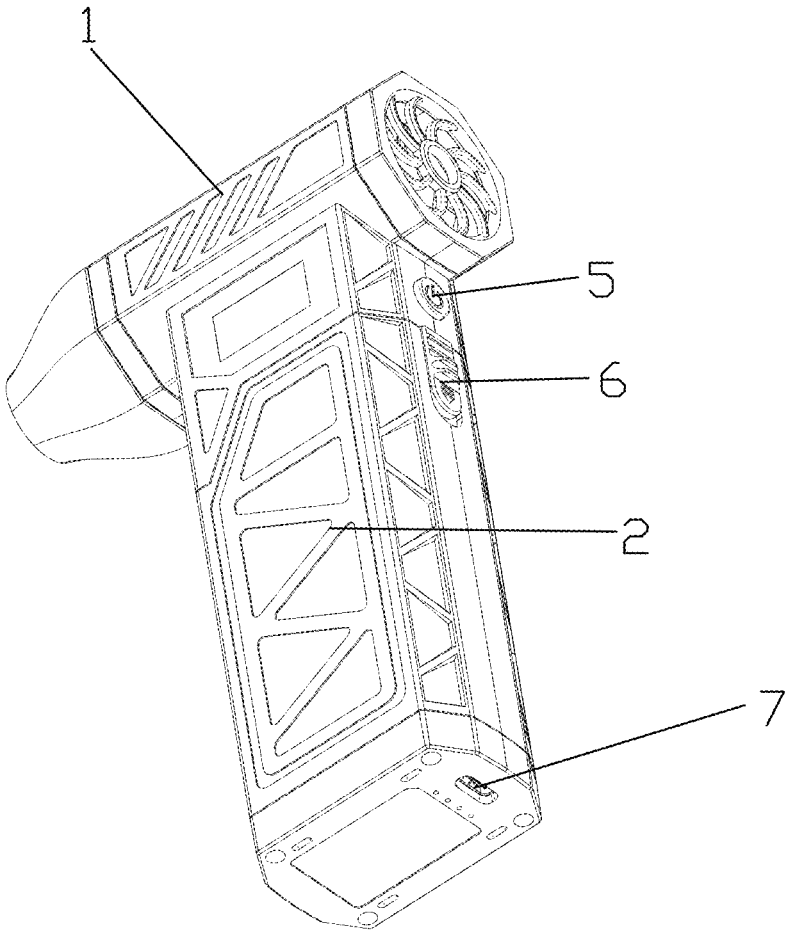
FIG. 2 is a bottom view of a handheld apparatus in the present invention.
Figure 3:
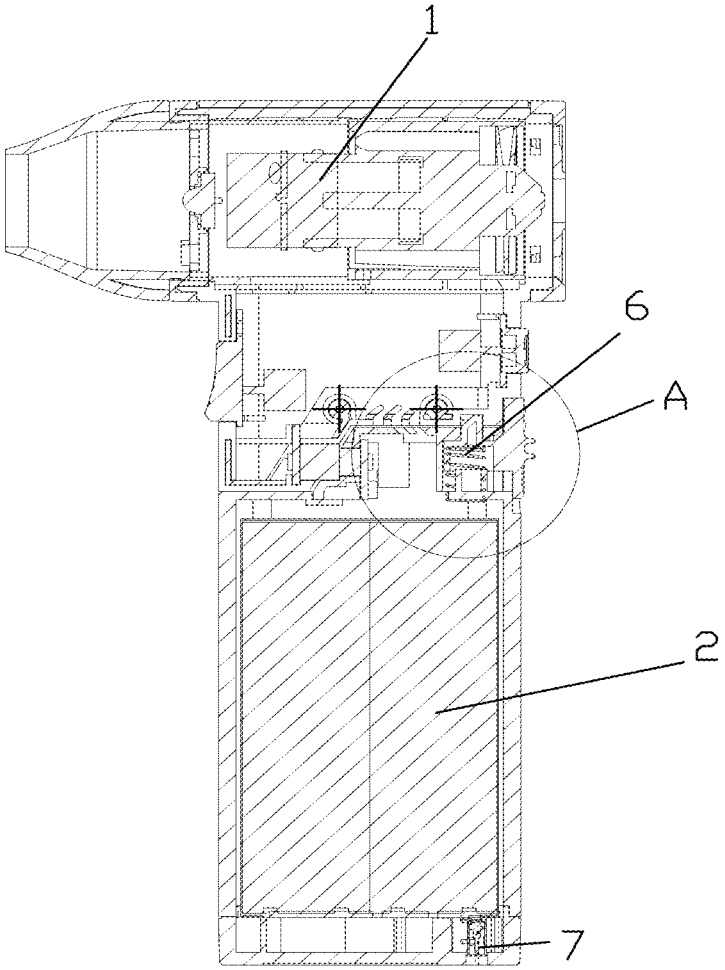
FIG. 3 is a cross-sectional view of a handheld apparatus in the present invention.
Figure 4:
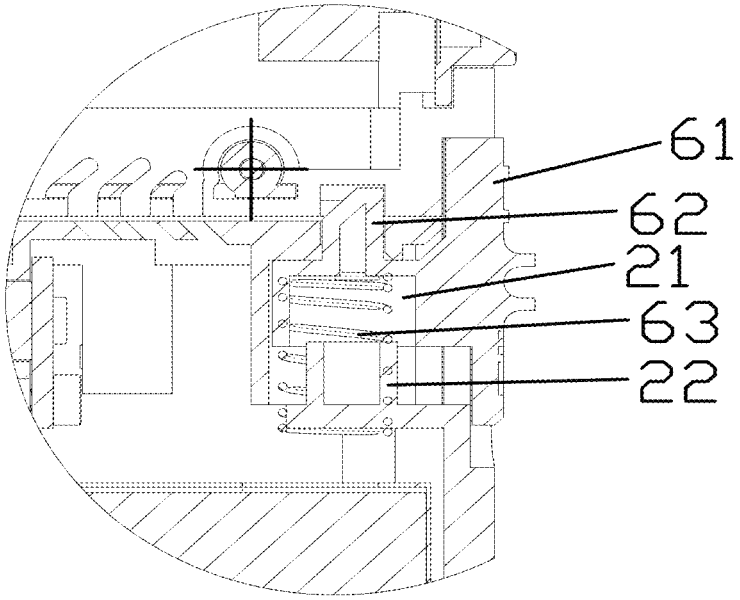
FIG. 4 is a partially enlarged view of a part A in FIG. 4.
Figure 5:
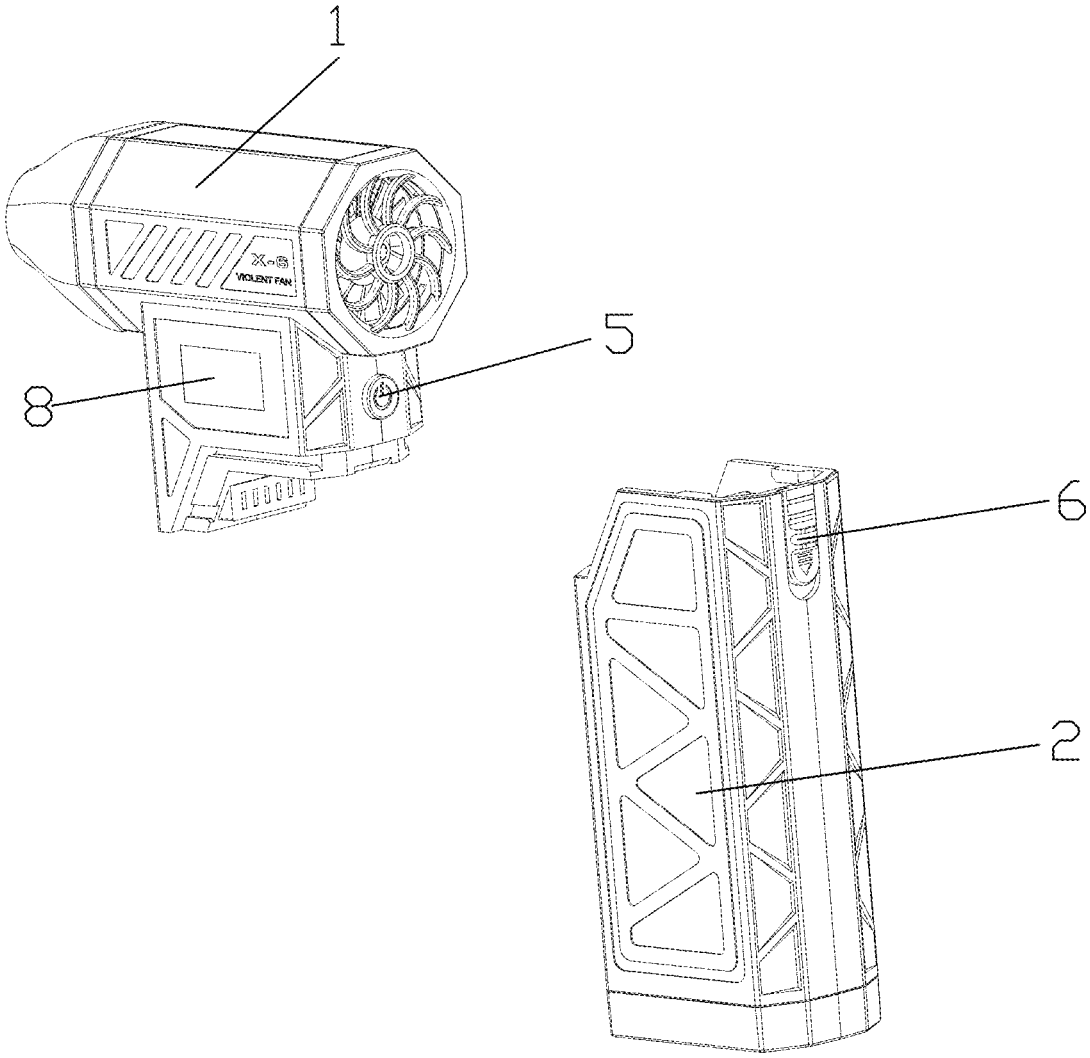
FIG. 5 is an exploded view of a handheld apparatus in the present invention.
Figure 6:
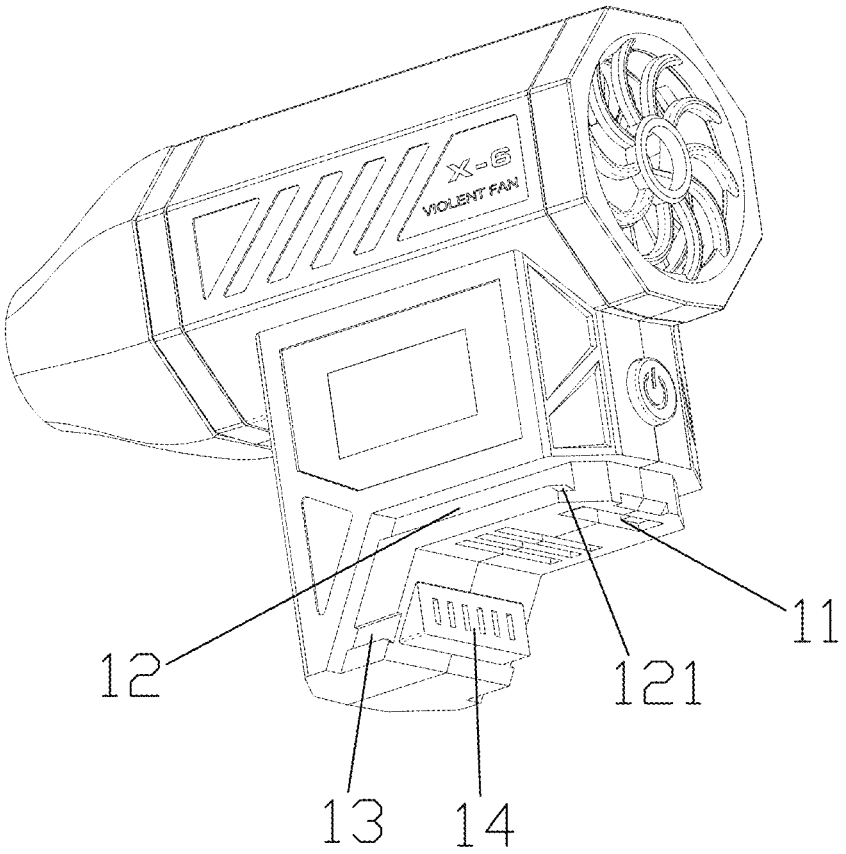
FIG. 6 is a schematic structural diagram of a fan body in the present invention.
Figure 7:
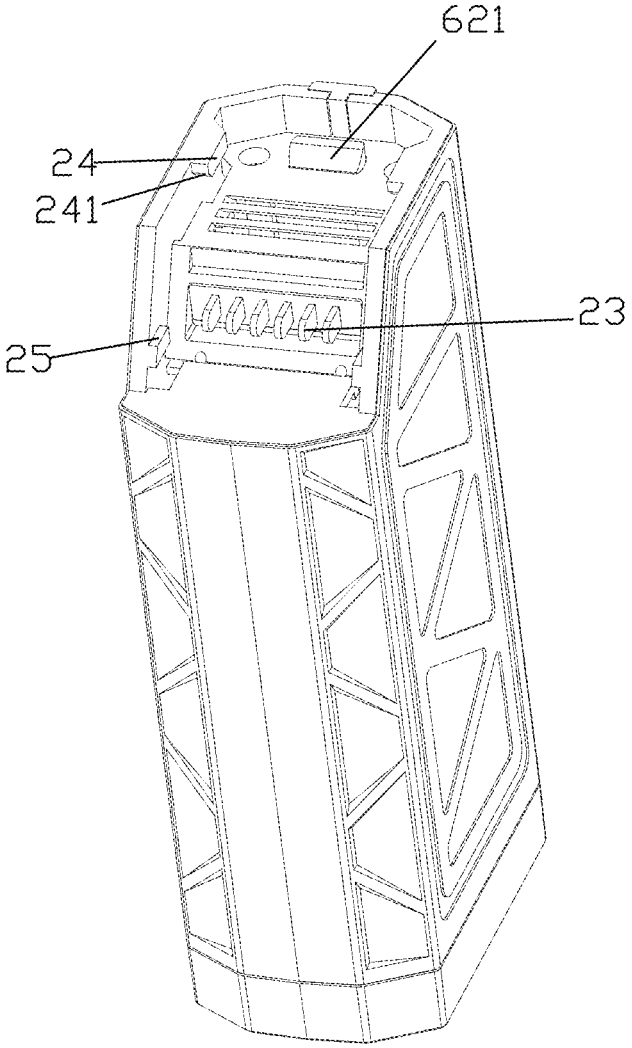
FIG. 7 is a schematic structural diagram of a handle in the present invention.

Referring to FIG. 1 to FIG. 7, an embodiment of the present invention proposes a handheld apparatus, including:

a fan body 1 provided with a snap-fit groove 11 at its bottom; and a handle 2, detachably installed on the fan body 1, where the handle 2 is provided with a locking mechanism 6, the locking mechanism 6 includes a key switch 61, a locking portion 62, and an elastic member 63, the key switch 61 is fixedly connected with the locking portion 62, and the elastic member 63 is located between the locking portion 62 and the handle 2, where the locking portion 62 and the snap-fit groove 11 have a locked state and an unlocked state; the key switch 61 is for a user to press to drive the locking portion 62 to move downward, so that the locking portion 62 and the snap-fit groove 11 are unlocked; and the elastic member 63 is configured to drive the locking portion 62 to move upward, so that the locking portion 62 and the snap-fit groove 11 are locked.

The present invention proposes a handheld apparatus, where the handheld apparatus includes the fan body 1 and the handle 2 detachably installed on the fan body 1. The fan body 1 is provided with the snap-fit groove 11 at its bottom, the handle 2 is provided with the locking mechanism 6, the locking mechanism 6 is composed of the key switch 61, the locking portion 62, and the elastic member 63, the key switch 61 is fixedly connected with the locking portion 62, and the elastic member 63 is located between the locking portion 62 and the handle 2. Through this structural design, the locked state and the unlocked state of the locking portion 62 and the snap-fit groove 11 can be switched. When the user presses the key switch 61, the locking portion 62 is driven to move downward, so that the locking portion 62 and the snap-fit groove 11 are unlocked, and at this time, the handle 2 can be removed from the fan body 1, to effectively reduce an overall volume of the fan, thereby facilitating storage and carrying and improving portability of the product. When the key switch 61 is released, the elastic member 63 drives the locking portion 62 to move upward by virtue of its own elasticity, so that the locking portion 62 and the snap-fit groove 11 are locked, to firmly install the handle 2 onto the fan body 1, thereby ensuring normal use of the fan. In addition, the charge/discharge module 7 is disposed on the handle 2 and can provide a charging service for another electronic device in outdoor or mobile scenarios, which expands functional practicability of the product and enhances competitiveness of the product on the market. In this embodiment, a motor is disposed inside the fan body 1 and configured to drive fan blades to rotate, and the motor is connected to the input terminal 14 at the bottom of the fan body 1 through an internal circuit to input power. A battery and a control circuit board are disposed inside the handle 2, the battery forms an electrical connection with the input terminal 14 of the fan body 1 through the output terminal 23, to stably supply power to the motor in the locked state, and the control circuit board sends a speed adjustment instruction or a mode switching signal to the fan body 1 through the output terminal 23. Further, a nozzle 3 is detachably installed at an end of the fan body 1 and is roughly a streamlined hollow cylindrical structure and configured to effectively guide the fan to generate an airflow to implement acceleration and concentration, thereby enhancing the wind force.

Further, a first clamping groove 12 and a second clamping groove 13 are disposed on sides of the fan body 1, a first clamping block 24 and a second clamping block 25 are correspondingly disposed on sides of the handle 2, the first clamping block 24 slidably fits the first clamping groove 12, and the second clamping block 25 is embedded into the second clamping groove 13 when the handle 2 is clamped into the fan body 1. Specifically, when installing the fan, the user aligns the first clamping block 24 on the handle 2 with the first clamping groove 12 on the side of the fan body 1, and applies pushing force along an extension direction of the first clamping groove 12, and at this time, the first clamping block 24 enters the first clamping groove 12 and slides along its track under the pushing force, to guide installation of the handle 2, so that the user can find a correct installation direction during installation, thereby avoiding structural damage or installation failure caused by installation deviation. With continuous advancement of the handle 2, when the handle 2 is close to a complete clamping position of the fan body 1, the second clamping block 25 on the side of the handle 2 corresponds to the second clamping groove 13 on the side of the fan body 1, and after the user continues to apply the pushing force, the second clamping block 25 is embedded in the second clamping groove 13, and the embedded second clamping block 25 is closely attached to the second clamping groove 13, and through a mechanical interlocking effect therebetween, multiple degrees of freedom of the handle 2 on the fan body 1 are effectively limited, to prevent the handle 2 from shaking or falling off during use, so that the handle 2 is firmly installed on the fan body 1, thereby ensuring stability and reliability of the overall structure of the fan and stable airflow of the fan during operation, and meeting use needs of the user in different scenarios. In addition, when needing to remove the handle 2, the user only needs to perform operations in reverse, and first presses the key switch 61 to drive the locking portion 62 to move downward, so that the locking portion 62 gradually detaches from the snap-fit groove 11, to be unlocked from the snap-fit groove 11, and after the locking portion 62 is unlocked, the user then pulls the handle 2 in an opposite direction of the first clamping groove 12 and the second clamping groove 13, so that the first clamping block 24 and the second clamping block 25 slide out of the first clamping groove 12 and the second clamping groove 13 respectively, and in this way, the handle 2 can be removed from the fan body 1. It should be noted that to achieve convenient assembly/disassembly of the fan body 1 and the handle 2, the user can flexibly choose between pushing/pulling the handle 2 or pushing/pulling the fan body 1 based on an actual use scenario, a personal operation habit and an ambient environment.

Further, a chamfer 121 is disposed at an entrance of the first clamping groove 12, and a guide slope 241 is correspondingly disposed at an end portion of the first clamping block 24. Specifically, when installing the fan, the user holds the handle 2 and moves the first clamping block 24 close to the first clamping groove 12 on the side of the fan body 1. Because the chamfer 121 and the guide slope 241 are respectively disposed at end portions of the first clamping block 24 and first clamping groove 12, even if there is certain minor deviation in an initial alignment process, for example inaccurate positioning caused due to slight shaking of the user's hand, deviation of a viewing angle, or limited operation space, the guide slope 241 of the first clamping block 24 first comes into contact with the chamfer 121 at the entrance of the first clamping groove 12, and the guide slope 241 slides naturally along an inclination direction of the chamfer 121, to automatically adjust a position and an angle of the first clamping block 24, so that the first clamping block 24 slides into the first clamping groove 12. The disposition of the chamfer 121 and the guide slope 241 facilitates installation and avoids problems such as an alignment difficulty caused due to the user's unskilled operation or visual error, and collision and scratching between the clamping block and an edge of the clamping groove, which effectively protects structural integrity of the first clamping block 24 and the first clamping groove 12, and prolongs service life of the product. Further, in this embodiment, a chamfer 121 is also disposed at the entrance of the second clamping groove 13, and a port, corresponding to the end portion of the second clamping block 25, on a side of the fan body 1 on which the second clamping groove 13 is located is configured to be in a shape of a fitted slope. In the installation process, after the first clamping block 24 slides into the first clamping groove 12, the second clamping block 25 comes into contact with the chamfer 121 at the entrance of the second clamping groove 13 through the slope at its end portion, and slides into the second clamping groove 13 along the inclination direction of the chamfer 121. A depth of the second clamping groove 13 is slightly greater than a height of the second clamping block 25, to ensure tight mechanical fitting when the second clamping groove 13 and the second clamping block 25 are engaged, and a slight gap is also reserved to avoid stress concentration caused due to tolerance or expansion and contraction in hot and cold environments. Further, in another embodiment, cushioning pads may also be disposed at the second clamping groove 13 and the bottom of the second clamping groove 13 to absorb vibration impact that may be caused during use, thereby further ensuring durability of the snap-fit structure.

Further, an input terminal 14 is disposed at a bottom of the fan body 1, the handle 2 is provided with an output terminal 23, and the input terminal 14 and the output terminal 23 form an electrical connection in a locked state. Specifically, when the handle 2 and the fan body 1 are completely locked, through precise fitting of the foregoing first clamping groove 12 and the first clamping block 24, and precise fitting of the second clamping groove 13 and the second clamping block 25, and locking engagement of the locking mechanism 6, with the handle 2 firmly installed on the fan body 1, the output terminal 23 of the handle 2 automatically aligns with and comes into close contact with the input terminal 14 at the bottom of the fan body 1, to implement stable transmission of power or a signal. Further, the input terminal 14 is connected to the internal circuit of the fan body 1, and the output terminal 23 is connected to the built-in battery or the control circuit board within the handle 2. In the locked state, the handle 2 can supply power to the fan through the output terminal 23 (for example, a built-in lithium battery of the handle 2 supplies power to the motor of the fan) or transmit a control signal (for example, instructions for adjusting a fan speed and switching modes), to implement multi-speed adjustment and operational mode switching of the fan.

Specifically, the input terminal 14 at the bottom of the fan body 1 is made of a copper alloy material with high conductivity and wear resistance, and has a surface treated with fine gold plating. A gold-plated layer is uniformly thick and dense, which not only can effectively reduce resistance to decrease electric energy loss during transmission and improve electric energy transmission efficiency, but also can enhance oxidation and corrosion resistance of the terminal to ensure maintenance of good conductivity during long-term use. The structure of the input terminal 14 is designed to be a combined structure with multiple elastic contact pieces, that is, an elastic point contact design is used for the input terminal 14 and the output terminal 23, and in this way, even if there is a slight assembly tolerance during the locking process, offset can still be compensated for through elastic deformation, thereby maintaining contact reliability. This electrical connection design implements "plug-and-play" intelligent operation through a synergistic mechanism of mechanical locking and circuit linkage: The user only needs to complete physical engagement between the handle 2 and the fan body 1 to simultaneously activate a power supply or control function, without any additional operation.

In another embodiment, an insulative protection ring is disposed on an outer side of the input terminal 14, and the output terminal 23 is correspondingly embedded inside the protection ring, to form a sealed connection, which effectively prevents intrusion of dust and moisture and enhances durability in outdoor environments.

Further, the handle 2 is provided with an installation cavity 21 for movement of the locking mechanism 6, and the locking mechanism 6 is installed in the installation cavity 21. A positioning post 22 is disposed in the installation cavity 21, and the elastic member 63 is sleeved onto the positioning post 22. In this embodiment, the installation cavity 21 is composed of a specific spatial structure formed by integral molding inside a housing of the handle 2, exhibiting a convex-shaped cross-section, and has a guide hole for allowing the locking portion 62 to slide at its top. The locking portion 62 vertically slides through this hole, and an operation window for exposing the key switch 61 is disposed on the side. The locking portion 62 and the key switch 61 are integrally formed structures and move linearly in the vertical direction within the installation cavity 21. An elastic member 63 is sleeved onto the positioning post 22 inside the installation cavity to prevent the elastic member 63 from shifting during expansion and contraction, thereby ensuring that the elastic member 63 can always stably drive the locking portion 62 to move in a predetermined direction. One end of the elastic member 63 abuts against a lower surface of the locking portion 62, while the other end abuts against a cavity wall at the bottom of the installation cavity 21, to provide upward elastic restoring force.

Further, a guide slope 621 is disposed on a side of the locking portion 62 in an installation direction of the fan body 1. In this embodiment, the guide slope 621 is inclined in an installation direction of the fan body 1, so that the snap-fit groove 11 comes into contact with and presses against the locking portion 62 when the fan body 1 is pushed toward the handle 2, to smoothly connect the fan body 1 with the handle 2 to complete the installation without further pressing the key switch 61, which simplifies an operation step and enhances user experience, thereby installing the fan body 1 more conveniently and efficiently.

Further, the key switch 61 is provided with anti-skid bulges. In this embodiment, the key switch 61 is provided with anti-skid bulges, the anti-skid bulges are evenly distributed on a surface of the key switch 61 in a wavy, dotted, or horizontal strip pattern. When the user presses the key switch 61, the anti-skid bulges increase a contact area and friction, which effectively prevents a pressing operation error caused due to slipping during operation with a wet, oily, or gloved hand.

Further, a fan speed adjustment switch 4 and a control switch 5 are disposed on a surface of the fan body 1. In this embodiment, the fan speed adjustment switch 4 and the control switch 5 form an electrical connection with a control circuit board disposed inside the handle 2. The fan speed adjustment switch 4 and the control switch 5 are disposed opposite each other, that is, the fan speed adjustment switch 4 is disposed on a front side of the fan body 1 and the control switch 5 is disposed on a rear side of the fan body 1. Through this arrangement, the user can easily touch the fan speed adjustment switch 4 with a right index finger while simultaneously touching the control switch 5 with a right thumb when using the fan, without requiring significant wrist movement during fan operation. Further, a display screen 8 is also disposed on the side of the fan body 1 and configured to display a present fan speed and operational mode, so that the user intuitively observes a real-time use status of the fan. In another embodiment, the fan body 1 can also be provided with an LED indicator light to provide real-time feedback of the current working status.

Further, a charge/discharge module 7 is also disposed on the handle 2. In this embodiment, the charge/discharge module 7 is disposed at the bottom of the handle 2, and the charge/discharge module 7 is provided with a charge/discharge interface. The charge/discharge interface is configured to charge an external electronic device during discharge mode or to charge the built-in battery in the handle 2 during charge mode. The charge/discharge module 7 is disposed, to serve as a mobile power supply when the handle 2 is detached from the fan body 1, which expands functionality of the product and enhances competitiveness of the product on the market. The charge/discharge interface can be Type-C interface, Micro-B interface, or another type of interface.

The foregoing description is only about an optional embodiment of the present invention, and is not intended to limit the patent scope of the present invention. Any equivalent structural modifications made under the inventive concept of the present invention using content of this specification and drawings of the present invention or direct/indirect application in other related technical fields shall be included in the patent protection scope of the present invention.

What is claimed is:

1. A handheld apparatus, comprising:

a fan body provided with a snap-fit groove at its bottom; and a handle, detachably installed on the fan body, wherein the handle is provided with a locking mechanism, the locking mechanism comprises a key switch, a locking portion, and an elastic member, the key switch is fixedly connected with the locking portion, and the elastic member is located between the locking portion and the handle, wherein the locking portion and the snap-fit groove have a locked state and an unlocked state; the key switch is for a user to press to drive the locking portion to move downward, so that the locking portion and the snap-fit groove are unlocked; and the elastic member is configured to drive the locking portion to move upward, so that the locking portion and the snap-fit groove are locked.

2. The handheld apparatus according to claim 1, wherein a first clamping groove and a second clamping groove are disposed on sides of the fan body, a first clamping block and a second clamping block are correspondingly disposed on sides of the handle, the first clamping block slidably fits the first clamping groove, and the second clamping block is embedded into the second clamping groove when the handle is clamped into the fan body.

3. The handheld apparatus according to claim 2, wherein a chamfer is disposed at an entrance of the first clamping groove, and a guide slope is correspondingly disposed at an end portion of the first clamping block.

4. The handheld apparatus according to claim 1, wherein an input terminal is disposed at a bottom of the fan body, the handle is provided with an output terminal, and the input terminal and the output terminal form an electrical connection in a locked state.

5. The handheld apparatus according to claim 1, wherein the handle is provided with an installation cavity for movement of the locking mechanism, and the locking mechanism is installed in the installation cavity.

6. The handheld apparatus according to claim 5, wherein a positioning post is disposed in the installation cavity, and the elastic member is sleeved onto the positioning post.

7. The handheld apparatus according to claim 1, wherein a guide slope is disposed on a side of the locking portion in an installation direction of the fan body.

8. The handheld apparatus according to claim 1, wherein the key switch is provided with anti-skid bulges.

9. The handheld apparatus according to claim 1, wherein a fan speed adjustment switch and a control switch are disposed on a surface of the fan body.

10. The handheld apparatus according to claim 1, wherein a charge/discharge module is also disposed on the handle.

* * * * *